United States Patent [19]

Ejnell et al.

[11] 4,260,160

[45] Apr. 7, 1981

[54] TARGET DEVICE FOR PRACTICE SHOOTING IN DARKNESS

[75] Inventors: Sture Ejnell, Kollered; Börje Arrdal, Mölnlyeke, both of Sweden

[73] Assignee: Saab-Scania AB, Linkoping, Sweden

[21] Appl. No.: 126,293

[22] Filed: Mar. 3, 1980

[30] Foreign Application Priority Data

Mar. 5, 1979 [SE] Sweden ..... 7901927

[51] Int. Cl.[3] ..... F41J 1/08; F41J 5/08

[52] U.S. Cl. ..... 273/408; 273/348; 250/503; 250/504 R

[58] Field of Search ..... 273/403, 404, 406, 407, 273/348; 250/503, 504

[56] References Cited

U.S. PATENT DOCUMENTS

| | | | |
|---|---|---|---|
| 2,972,053 | 2/1961 | Anderson | 273/348 X |
| 3,685,830 | 8/1972 | Holm | 273/348 |
| 4,119,317 | 10/1978 | Ohlund et al. | 273/406 |

*Primary Examiner*—Anton O. Oechsle

*Attorney, Agent, or Firm*—James E. Nilles; James R. Custin

[57] ABSTRACT

A target for night-time gunnery and similar practice with the use of a heat responsive sight comprises a thin, supple fabric supported on a rigid frame to be substantially flat, with a front surface facing towards a location from which firing takes place. The fabric comprises a front protective sheet, preferably plastic, which is transparent to infra-red radiation, and a rear radiation-absorbing sheet of low heat capacity, preferably foil. A coarse-mesh net, between said sheets and secured to both, holds them spaced and parallel to cooperate in defining a heat insulating air space between them. An infra-red radiator heats the heat-absorbing sheet, which preferably has a radiation absorbing matte coating on its rear surface and a colored front surface coating. When warmer than its surroundings, the heat absorbing sheet thus radiates as a black body. With one or both coatings having different densities in different areas, the target image in a heat responsive sight can closely simulate that of a specific heat-emitting object which might have to be engaged in combat.

8 Claims, 3 Drawing Figures

TARGET DEVICE FOR PRACTICE SHOOTING IN DARKNESS

FIELD OF THE INVENTION

This invention relates to a target device that is suitable for gunnery or similar practice in darkness; and the invention is more particularly concerned with a target device which is detectable at a distance by means of a sniperscope or heat responsive camera, said target device comprising a thin and light wall-like structure that can be arranged to face towards a location from which weapon firing takes place and to provide a realistic simulation of an object that normally emits heat radiation and at which weapons would be fired.

BACKGROUND OF THE INVENTION

As is well known, it is now possible, with the use of a so-called sniperscope or heat camera, to detect and form an image of an object that emits infra-red radiation. The technology has been refined to such an extent that a clear thermal picture can be obtained at a substantial distance from an object, even if the temperature of the object exceeds that of its surroundings by only a few degrees. Equipment embodying this technology is finding military applications in, for example, installations comprising tank weapons and anti-tank defense weapons, wherein heat responsive devices are used for night-time weapon aiming.

The use of heat-responsive sighting equipment requires special training, because the image presented by such a device is of a different character than that perceived with visible light. Accordingly, it is necessary to afford extensive night-time practice to personnel who are expected to use such equipment, in order to develop their ability to detect targets and to recognize objects of the type at which they may have to fire in actual combat. For such training it is necessary to have targets which will emit heat radiation patterns that realistically simulate specific objects at which combat fire might be aimed, to enable realistic practice operations to be conducted at night.

One type of practice target heretofore proposed for this purpose comprised a metal plate having the outline of a tank or other object to be simulated, together with a burner of some kind that directly heated the plate to raise its temperature above that of its surroundings. A real object at which combat firing would be conducted ordinarily has a pattern of different temperatures, which influence the image of the object at a heat responsive device, but a heated plate tends to have a substantially uniform temperature across its entire surface and therefore its thermal image poorly simulates a real object. Such a heated-plate target was further unrealistic in that it tended to warm up and cool off rather slowly, and therefore it could not satisfactorily simulate a moving vehicle or the like which may appear and disappear rather abruptly. High energy consumption was also a disadvantage of such a target. Furthermore, the plate had to have substantial thickness in order not to be burned through by the heater, and therefore it was heavy and difficult to move.

In another and somewhat better proposal for a thermal target, the necessary elevated temperature was obtained by means of a resistance wire network that extended over the target, or over such portions of a target surface as corresponded to an object to be simulated, and this network was connected with a battery or other current source. The time required for heating and cooling was relatively short, the profile of an object to be simulated could be reproduced fairly well, and the device was relatively light in weight and easily moved. A serious disadvantage, however, was the excessive vulnerability of the target to weapon fire. A shot placed on the electrical resistance network tended to break a part of the circuit or all of it, so that no more than a few hits the target lost its resemblance to the object it was intended to simulate and became substantially useless for training purposes.

SUMMARY OF THE INVENTION

In general it is an object of this invention to provide a target suitable for night-time gunnery practice and the like with the use of a heat sensitive sighting device, which target is light, easily transportable and inexpensive, can produce a heat radiation pattern closely simulating that of an object at which fire would be directed in combat, has a low energy consumption, and retains its usefulness for training purposes even after it has taken a substantial number of hits.

It is also an object of the invention to provide a target device of the character described that can be caused to start and stop its emission of radiation rather quickly, so that for an observer viewing it through a heat responsive sight it can be caused to simulate an object which rather suddenly springs up out of the surrounding terrain or disappears into it.

Another and very important object of the invention is to provide a target device of the character described which makes possible not only the mere simulation of a heat radiating object having a desired outline, but a more detailed and refined thermal simulation wherein different radiation temperatures emanate from different predetermined areas of the target, so that the image which the target presents to a heat sensitive sight or the like faithfully reproduces that of a real object and enables use of the target for realistic training in detecting and identifying such objects.

It is also an object of this invention to provide a target of the character described that comprises a substantially supple fabric which is supported on a light, rigid frame and which has the ability to absorb radiation and quickly attain an elevated temperature, whereupon it is able to radiate heat as a black body, such heat radiation being confined to a predetermined pattern which can be arranged to afford predetermined variations in radiation temperature in predetermined different portions of the pattern.

A more specific object of the invention is to provide a target device comprising a fabric of the character described that has a plurality of layers and wherein one of said layers provides for heat absorption and heat radiation while another layer affords protection for the layer that absorbs and radiates heat while at the same time performing a significant and novel heat insulating function.

In general, these objects of the invention and others that will appear as the description proceeds are realized in a target suitable for gunnery and similar practice in darkness and which can be detected at a distance by a heat responsive device, which target comprises a supple fabric attachable to a rigid frame to be supported thereby in substantially flat condition, with a front surface of the fabric facing towards a location at which practice firing takes place. Said fabric is characterized by a heat absorbing sheet having low thermal capacity and which undergoes rapid rise in temperature in response to its absorption of radiation, so as to emit thermal radiation as a black body; a protective sheet overlying the front surface of said heat absorbing sheet, said protective sheet being substantially transpartent to thermal radiation; and means interposed between portions of said heat absorbing sheet and said protective sheet to hold them in spaced apart substantially parallel relationship so that they define a heat insulating space in the fabric.

BRIEF DESCRIPTION DRAWINGS

In the accompanying drawings, which illustrate what is now regarded as a preferred embodiment of the invention:

DETAILED DESCRIPTION OF PREFERRED EMBODIMENT OF INVENTION

Figure 1:
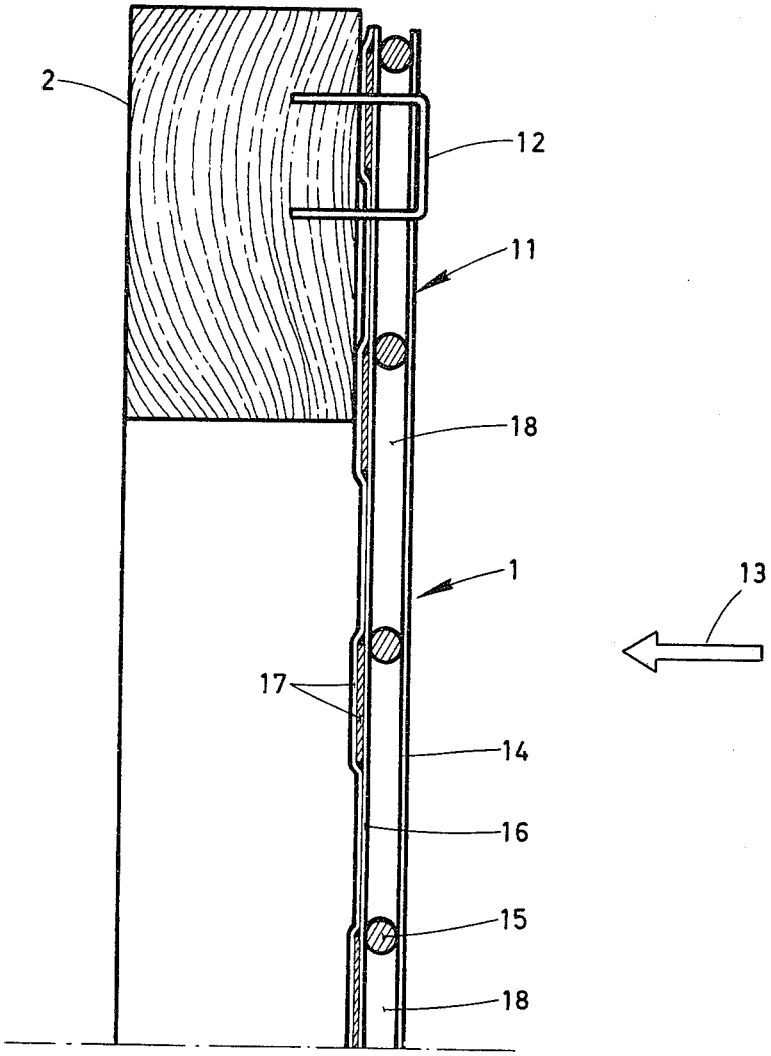
FIG. 1 is a view in cross-section through a portion of a target device embodying the principles of this invention.

Referring now to the accompanying drawings, the numeral 1 designates generally a target surface of a target device particularly intended for practice in darkness with a heat-detecting sighting device. The target surface 1 is generally of such form and size that it simulates the silhouette of an object at which firing would take place in actual combat, and in this case it simulates a tank as seen from its front.

At its bottom and at its sides the outline of the target surface 1 is defined by frame pieces 2, which are preferably of wood and which comprise a stand 3. The top edge of the target surface is defined by a horizontal frame piece 4 and two triangular, gusset-like corner pieces which define non-radiating corner areas 6, each with an inner edge 5 that extends diagonally down from the top piece.

Figure 2:
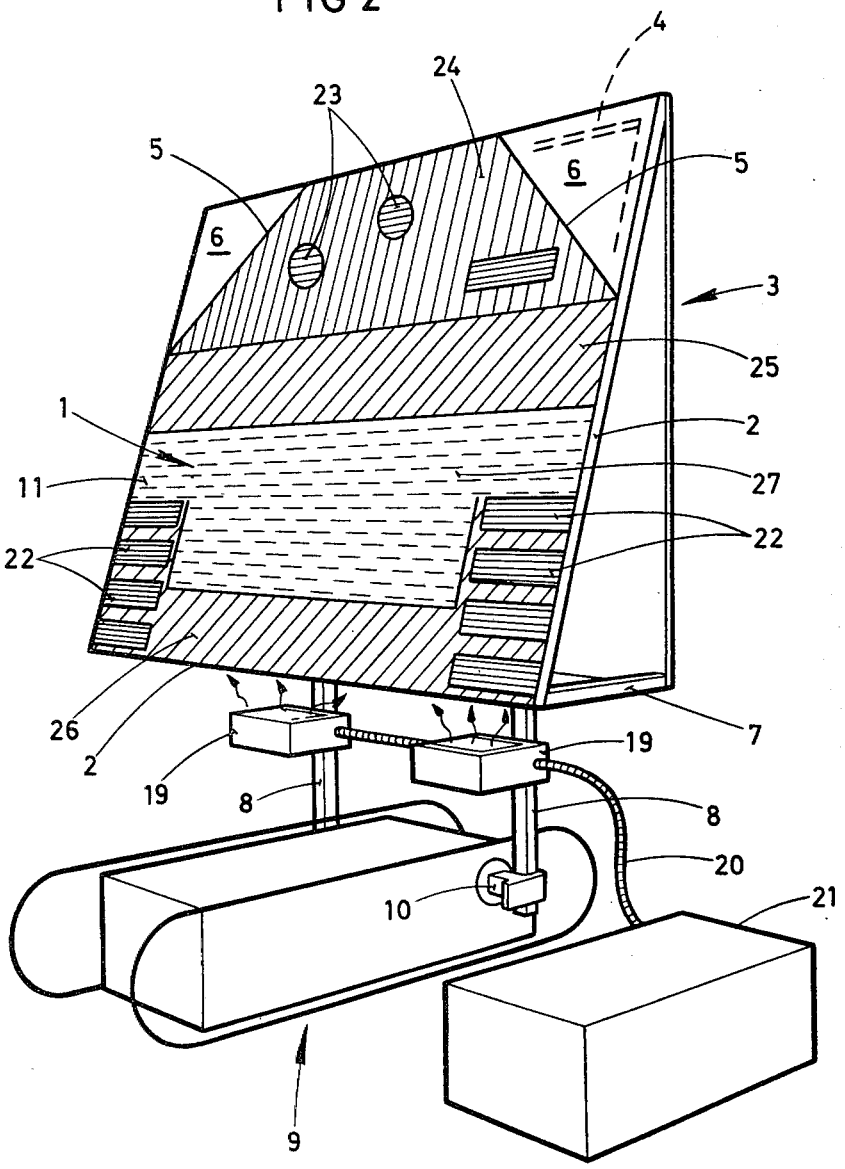
FIG. 2 is a perspective view of the target device.

The stand 3 also comprises a plate-like back piece B which is connected with the top piece 4 along its length and diverges rearwardly and downwardly from the frame 2, 4. Rearwardly extending cross-beams 7 connect the bottom of the frame 2, 4 with the bottom of the back piece B at opposite sides of the stand 3, so that the stand is substantially rigid and prism-shaped. The stand 3 is supported on a pair of legs 8, one at each of its sides, which have their lower ends secured to opposite ends of a rotatable horizontal shaft 10. The shaft 10, in turn, extends through a carrier unit 9 in which there is a motor (not shown) or the like whereby the shaft 9 can be rotated to swing the stand 3 between the operative, substantially upright position in which it is shown in FIG. 2 and an inoperative position in which the target surface 1 is substantially horizontal and extends away from the location from which firing at the target is conducted. The position of the target stand 3 can be remotely controlled, as by means of radio control apparatus (not shown).

The whole of the target surface 1—including also the non-radiating areas 6—comprises a supple fabric 11 which is secured to the stand 3 by means of staples 12 or the like that are driven into the frame pieces 2 and 4 (see FIG. 1). In order to have the desired thermal characteristics, the fabric 11 is built up generally as shown in FIG. 1, but it will be understood that, for simplicity, the thickness of the fabric is greatly exaggerated in that figure. Considered in the direction in which firing at the target takes place—which direction is denoted by the arrow 13—the fabric 11 comprises a front protective sheet 14, preferably of plastic or similar material that is transparent to infra-red radiation, an intermediate coarse-mesh net 15 which can be of plastic or textile, and a heat absorbing rear sheet 16 which is preferably of aluminum foil but which can be a thin fibre sheet such as grey paper.

Overlying the rear surface of the heat absorbing sheet 16 is a reinforcement which can comprise a network of horizontally and vertically extending bands 17 of glass fibre or the like, preferably forming a checkerboard pattern and serving to increase the resistance of the fabric 11 to tearing so that a durable fastening of the fabric to the frame 2, 4 can be made by means of the staples 12. An additional important consequence of the provision of the reinforcing bands 17 is that the area of the fabric 11 that is torn by a projectile hitting the target surface 1 is, in general, limited to one of the squares defined by the bands, whereas without such reinforcement a substantially larger area of the fabric would be damaged by each hit, and after a few hits the target would become practically unusable.

The purpose of the coarse-mesh net 15 that is interposed between the heat absorbing sheet 16 and the protective front sheet 14 is to maintain those sheets in spaced apart, substantially parallel relationship to one another so that they cooperate in defining a heat-insulating air space 18, or, more specifically, a layer of closed air cells, separated by the net filaments. Especially in rainy or windy weather, and when ambient temperatures are low, the dead air space thus produced by the protective sheet 14 prevents loss of heat by convection from the heat absorbing sheet 16. The net 15 is secured to the two sheets 14 and 16 by means of a suitable adhesive medium or by thermal bonding.

Instead of the coarse-mesh net 15 being made up of circular-cross-section filaments, as shown, it can comprise double-sided self adhering bands. In that case it vertical filaments might be eliminated, and the sheets 14 and 16 could be held spaced apart by parallel horizontal bands defining transverse channel-like air spaces.

From the standpoint of heat insulation it is also advantageous to close the triangular openings at both sides of the stand 3, between the side frame members 2 and the side edges of the back plate 3, as by means of fiber board or similar material, so that the space defined by the target device as a whole opens only downwardly.

In addition to the stand 3 and the fabric 11, the device according to the invention comprises means for irradiating the fabric 11, said means, in the illustrated example, comprising a pair of radiation sources 19 which face upwardly into the free space within the stand 3 and are placed at a level low enough to be protected from projectiles by a shield (not shown) placed in front of the target device. Of course the radiation from the radiators 19 is screened off from the location from which firing at the target takes place, both by the armor shielding for them and by reason of their being directed generally away from that location. A suitable type of radiation source 19 is a gas fueled radiation heater which shows no visible light but emits radiation in the infra-red range and which is light, readily available commercially, and has low temperature sensitivity. Radiators comprising high intensity infra-red electric lamps could also be used. As shown, the radiant heaters 19 are connected by means of a hose 20 with a pressure gas bottle that is housed in a protective enclosure 21. By means of an electric igniter (not shown) that can be remotely controlled in the same manner as the mechanism comprising the shaft 10 by which the target is raised and lowered, the radiation sources 19 can be so activated that they become fully effective at the same time that the target is raised to its operative position; or, if the target is to be maintained more or less continuously upright during a practice session, the radiators can be operated only at those times when firing at the particular target is to take place and can be extinguished or operated at low intensity at other times.

An uncoated aluminum foil, like a paper sheet, is characterized by a low heat capacity, and in this respect aluminum foil and gray paper fulfill the requirement that the back sheet 16 of the fabric 11 be capable of being heated with low energy consumption. However, untreated foil surfaces do not have the capabilities for heat absorption and for radiation emission that are required for the purposes of the target of this invention, and therefore the back sheet should be coated or overlaid to give it a dull or matte surface which better affords these characteristics. Providing a dark colored surface on the back of the foil substantially improves its capability for absorbing the infra-red radiation which emanates from the target environment and from the radiators 19, as well as for absorbing any visible light, with the result that the foil quickly attains an elevated temperature.

If the front surface of the back sheet 16 is covered or coated with a suitable color—which need not be dark—the emissivity of the sheet rises to a value which can be at least ten times better than that for an uncoated metal surface. Such increased emission implies a correspondingly elevated equivalent radiation temperature (or radiance) from the front surface of the sheet. And since the present heat detecting sighting equipment is sensitive to just such self-emitted radiation, the corresponding image element in the detected thermal image has the appearance of having been produced by pronounced heat.

If the coating is applied to one or both surfaces of the foil as small surface elements or dots, in the manner of a raster, the effects of the coating are diminished to the same extent as its density, that is, absorption and emission are respectively reduced in proportion to the quotient of the areas between the dots or coating elements divided by the total area of the foil. It will be apparent that the intensity of radiation from any one area of the foil or sheet 16 can be varied in relation to that from another area by suitable proportioning of the density (closeness) of the dots or surface elements in the respective areas. The individual surface elements need not be larger than 5 mm.

It will be evident that the combined effect of the coatings or overlays on both sides of the sheet 16 is determinative of the radiation-absorbing and radiation-emitting characteristics of the various areas of the sheet and therefore of how warm each area of the sheet seems to be from the standpoint of the image that appears at a heat sensitive sighting device. As a result, the invention can be applied to the production of targets which closely simulate the radiation patterns of real objects, surface area by surface area, by the provision of coated surface element areas on the respective front and back surfaces of the sheet 16 which are so arranged that they improve absorption and/or radiation of emission in suitably different degrees, and such variations can be controlled over a wide range in accordance with the typical radiation pattern from the particular object which the target is intended to thermally simulate. The following relationships can be laid down as a generally applicable rule:

| Desired Radiance Value | Coating | Surface |
|---|---|---|
| High | Wholly covered dark | Back |
| | Wholly covered | Front |
| Medium, varying | Wholly covered dark | Back |
| | Varying density | Front |
| Medium, varying | Varying density | Back and Front |
| Low | Wholly covered or low density, dark | Back or Front |
| | Untreated | Back or Front |

Figure 3:
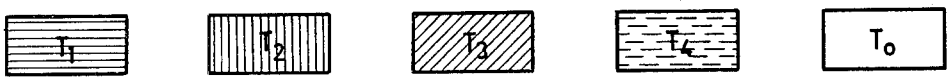
FIG. 3 is a key which explains the relationship between the several surface shadings used in different portions of FIG. 2 and the radiance to be emitted from the surface portions depicted with the respective shadings.

In the case of the dummy tank target illustrated in FIG. 2, a number of smaller fields of the total surface area are formed by means of such coating arrangements, to produce a pattern of different radiation intensities typical of a tank. As denoted by the shading code given in FIG. 3, a high equivalent radiation temperature $T_1$ is produced by the areas 22, 23 of the target surface that would generally correspond to the treads and to the gun barrels and cannon, respectively, of an actual tank, while the turret area 24 would produce a somewhat lower radiation temperature $T_2$. The part 25 below the turret and the underframe 26 would have a still lower temperature $T_3$. The remaining portions 27 of the target surface would have the lowest radiance value $T_4$, only a few degrees higher than the environmental temperature $T_0$ at the surface areas 6.

In the foregoing description it has been assumed that the front sheet 14 of the fabric 11 was completely transparent to infra-red radiation. However, in a modified form of the invention that sheet 14 can be coated or painted with a color that damps radiant emissions from the rear sheet 16. The emission-damping coating can overlie one or both surfaces of the front sheet 14 and can be either continuous or in the form of dots or small surface elements which have various degrees of density in various parts of the area of the sheet, as explained above.

For further increasing the realism of a dummy target of this type it can be so arranged that its surface facing the location from which shooting is conducted reflects radiation in the visible range. For that purpose the front surface of the heat absorbing sheet 16, or of the protective sheet 14, can have a coating over its appropriate portions which gives a diffused reflection of visible light such as would be usual from a military vehicle, at the same time that the sheet has the above described characteristics with respect to emission and damping of radiation. This measure can of course be combined with provision for varying degrees of radiation absorption by the sheet 16 over different parts of its surface, in order to obtain a varying radiance from it as described above. In that case, with the target surface 1 tilted backward to some extent, as it is shown in FIG. 2, the natural light from the sky in clear weather can be used for night-time practice in detecting and identifying the target by direct visual observation, without employment of the radiation sources 19.

In order to obtain different absorption and emission capabilities in different parts of the heat absorbing sheet 16, whereby different parts of the target will present the appearance of having different temperatures, certain parts of that sheet can be of paper or the like—for example, the portion designated by 27 in FIG. 2—while the remaining portions are of metal foil.

Finally, attention is directed to the fact that the radiator means 19 can be placed at the front side of the target, in which case, of course, heat absorbing means would have to be provided only on the front side of the back sheet 16 in order to obtain the desired radiance from it. In that case the rear surface of the back sheet would be heat insulated in the same manner as is explained above with respect to the front surface.

From the foregoing description taken with the accompanying drawings it will be apparent that this invention provides a target suitable for night-time training with heat responsive sighting devices whereby the pattern of radiation emissions from a real heat-emitting object can be accurately simulated and which has light weight, low energy consumption and the ability to take a large number of hits and still remain useable.

What is claimed as the invention is:

1. A target suitable for gunnery or similar practice in darkness with the use of a heat responsive sighting device, said target comprising a substantially supple fabric attachable to a frame to be supported thereby in substantially flat condition with a front surface of the fabric facing towards a location from which practice firing takes place, said fabric being characterized by:

A. a heat absorbing sheet having low thermal capacity so as to undergo rapid rise in temperature in response to its absorption of radiation and which emits thermal radiation as a black body;

B. a protective sheet overlying the front surface of said heat absorbing sheet, said protective sheet being substantially transparent to thermal radiation; and C. means interposed between portions of said heat absorbing sheet and said protective sheet to hold them in spaced apart substantially parallel relationship so that they define a heat insulating space in the fabric.

2. The target of claim 1 further characterized by: said heat absorbing sheet being of metal foil and having coatings on portions of both of its surfaces for improving its absorption and emission of radiation.

3. The target of claim 1, further characterized by: said means interposed between said sheets comprising a coarse-mesh net to which both of said sheets are adhered.

4. The target of claim 1, further characterized by:

D. infra-red radiator means directed towards said heat absorbing sheet and the radiation from which is screened off from said location.

5. The target of claim 1, further characterized by: one of said sheets having a coating on at least one of its surfaces whereby the intensity of radiation from the fabric is influenced, which coating is of different densities on different portions of the sheet to simulate the different radiances that emanate from different portions of a heat emitting object.

6. The target of claim 1, further characterized by:

D. a network of laterally spaced bands overlying and secured to the rear surface of said heat absorbing sheet to limit tearing thereof upon its being hit by a projectile.

7. The target of claim 4 wherein said fabric and a supporting wall behind it cooperate to substantially enclose an upwardly convergent prism-shaped space, in a bottom portion of which said radiator means is located.

8. The target of claim 7, further characterized by: said fabric being rearwardly and upwardly inclined and having a front surface which reflects visible light so that the target can be detected with the aid of natural light from the sky as well as by its self-emitted radiation.

* * * * *